US010524579B1

(12) United States Patent
Butler, Jr.

(10) Patent No.: US 10,524,579 B1
(45) Date of Patent: Jan. 7, 2020

(54) CORNER CHAIR ASSEMBLY

(71) Applicant: Theodore R. Butler, Jr., Pittsburgh, PA (US)

(72) Inventor: Theodore R. Butler, Jr., Pittsburgh, PA (US)

( * ) Notice: Subject to any disclaimer, the term of this patent is extended or adjusted under 35 U.S.C. 154(b) by 6 days.

(21) Appl. No.: 16/044,597

(22) Filed: Jul. 25, 2018

(51) Int. Cl.
*A47C 7/74* (2006.01)
*A47C 7/56* (2006.01)
*A47C 1/121* (2006.01)
*A47C 4/04* (2006.01)

(52) U.S. Cl.
CPC ..... *A47C 7/744* (2013.01); *A47C 1/121* (2013.01); *A47C 4/04* (2013.01); *A47C 7/56* (2013.01)

(58) Field of Classification Search
CPC .. A47C 7/744; A47C 7/56; A47C 7/74; A47C 1/121; A47C 1/126; A47C 4/04; A47C 9/06; A63C 19/005
USPC ..... 297/180.13, 180.14
See application file for complete search history.

(56) References Cited

U.S. PATENT DOCUMENTS 3,073,560 A 1/1963 Montgomery
3,594,037 A * 7/1971 Sherman ..... A47C 1/036 297/14
4,087,127 A * 5/1978 Lotta ..... A47C 9/06 108/81
5,613,729 A * 3/1997 Summer, Jr. ..... A47C 7/74 297/180.11
6,089,651 A * 7/2000 Carmen ..... A47C 1/126 248/501
7,070,231 B1 * 7/2006 Wong ..... B60N 2/6027 297/180.11
7,665,803 B2 2/2010 Wolas
7,866,743 B1 * 1/2011 Russell ..... A47C 7/74 297/180.1
7,985,143 B1 7/2011 Daxon
9,173,500 B2 * 11/2015 Squires ..... A47C 7/744
2003/0060298 A1 3/2003 English
2005/0088020 A1 4/2005 Munoz
2010/0164256 A1 7/2010 Salisbury
2012/0299339 A1 * 11/2012 Birch ..... A01M 31/02 297/188.01
2014/0368012 A1 * 12/2014 Burd ..... B64D 11/06 297/337

* cited by examiner

*Primary Examiner* — Mark R Wendell

(57) ABSTRACT

A corner chair assembly for seating and cooling a competitor includes a frame that is coupled to an enclosure of a competition ring. A power module and an actuator are coupled to the frame. A fan it coupled to a first plate, which is coupled to and extends between a first side and a second side, proximate to a top, of the frame. The actuator and the fan are operationally coupled to the power module. A second plate is hingedly coupled to a lower edge of the first plate. The actuator is configured to selectively urge the second plate from a stowed configuration, wherein the second plate is positioned coplanarly with the first plate, to a deployed configuration, wherein the second plate extends substantially perpendicularly from the first plate. The second plate is configured to seat a competitor, positioning the fan to blow air onto the competitor.

14 Claims, 5 Drawing Sheets

CORNER CHAIR ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

(2) Description of Related Art Including Information Disclosed Under 37 CFR 1.97 and 1.98

The disclosure and prior art relates to chair assemblies and more particularly pertains to a new chair assembly for seating and cooling a competitor.

BRIEF SUMMARY OF THE INVENTION

An embodiment of the disclosure meets the needs presented above by generally comprising a frame that is coupled to an enclosure of a competition ring. A power module and an actuator are coupled to the frame. A fan it coupled to a first plate, which is coupled to and extends between a first side and a second side, proximate to a top, of the frame. The actuator and the fan are operationally coupled to the power module. A second plate is hingedly coupled to a lower edge of the first plate. The actuator is configured to selectively urge the second plate from a stowed configuration, wherein the second plate is positioned coplanarly with the first plate, to a deployed configuration, wherein the second plate extends substantially perpendicularly from the first plate. The second plate is configured to seat a competitor, positioning the fan to blow air onto the competitor.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
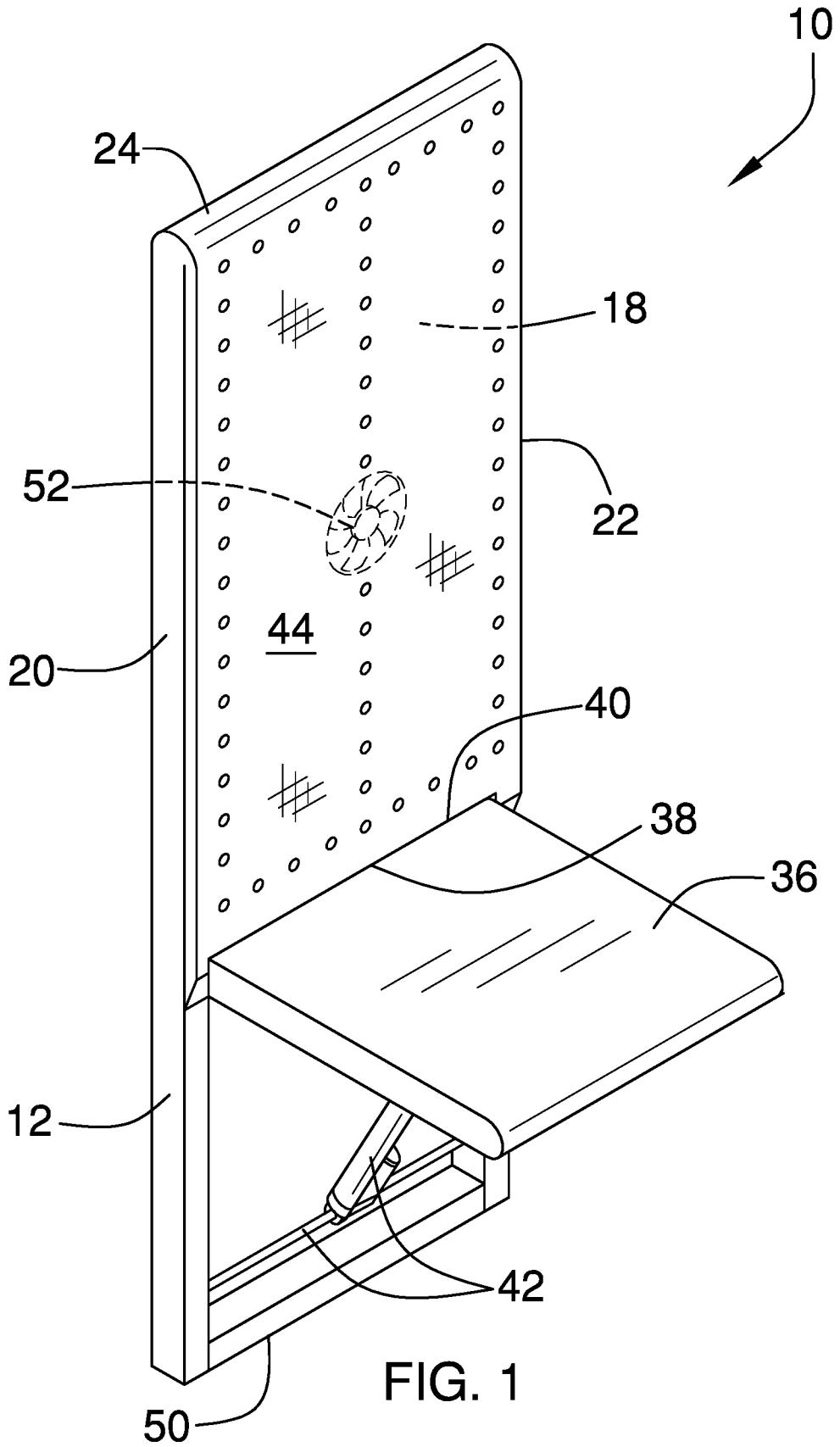
FIG. 1 is an isometric perspective view of a corner chair assembly according to an embodiment of the disclosure.

With reference now to the drawings, and in particular to FIGS. 1 through 5 thereof, a new chair assembly embodying the principles and concepts of an embodiment of the disclosure and generally designated by the reference numeral 10 will be described.

Figure 3:
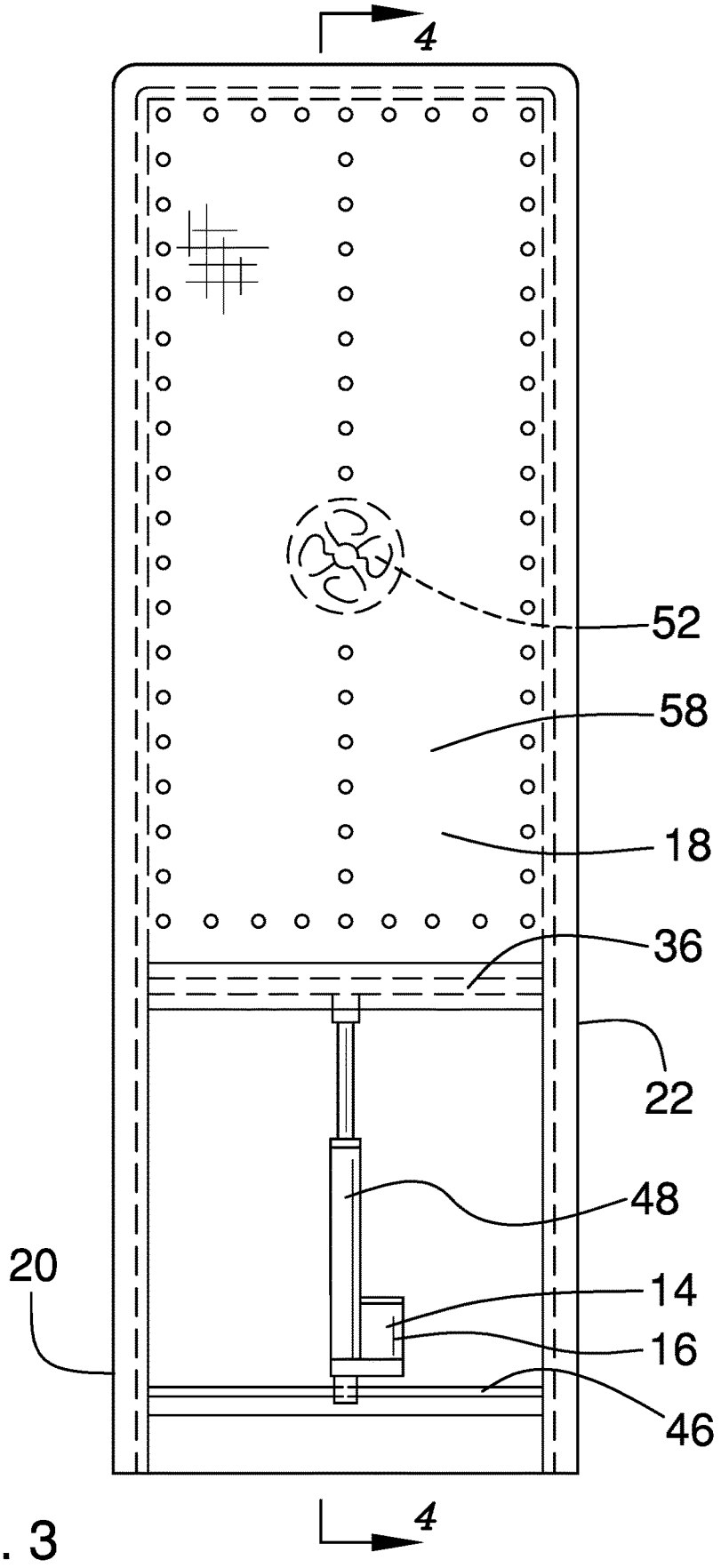
FIG. 3 is a front view of an embodiment of the disclosure.
Figure 4:
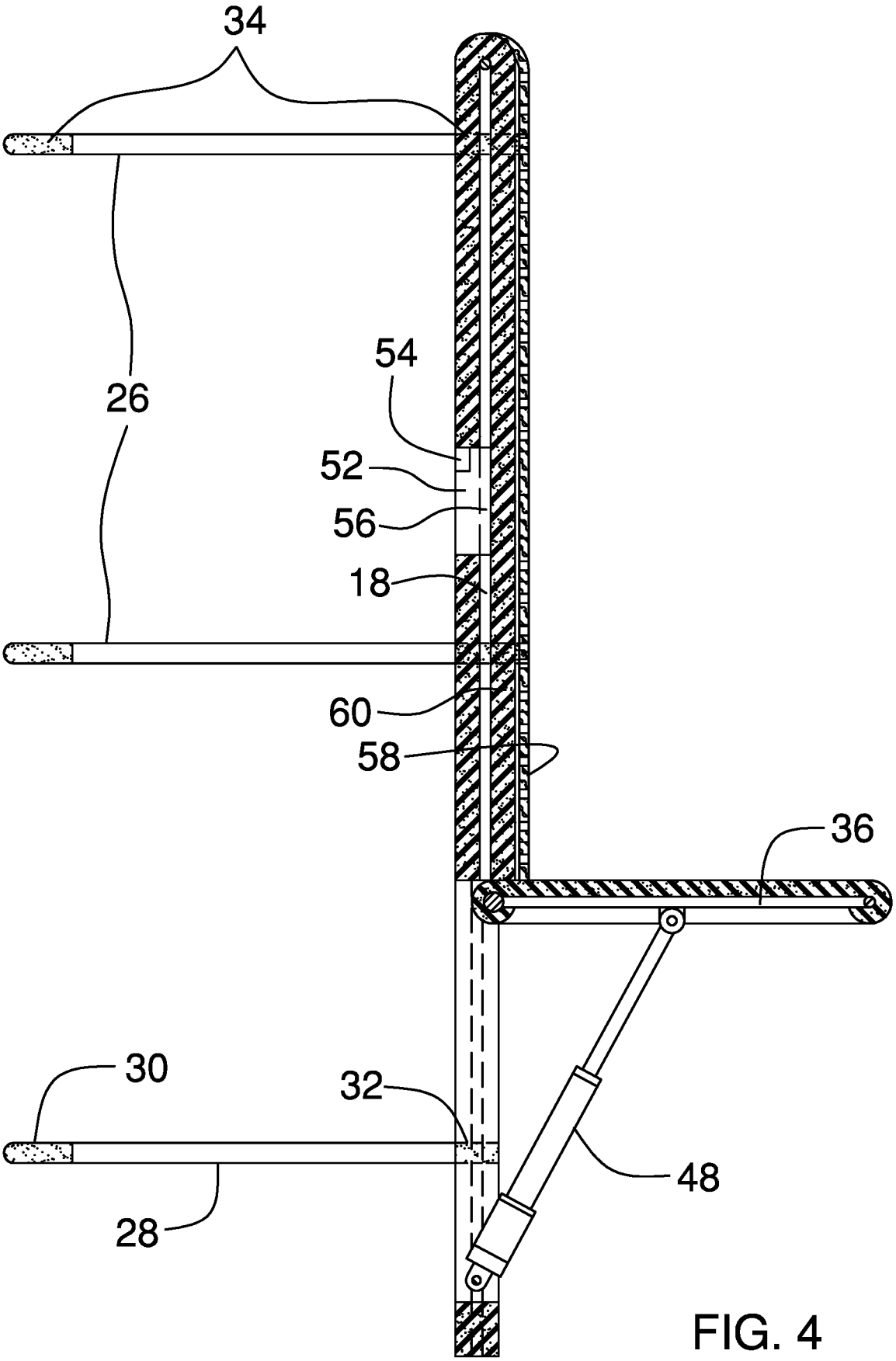
FIG. 4 is a cross-sectional view of an embodiment of the disclosure.
Figure 5:
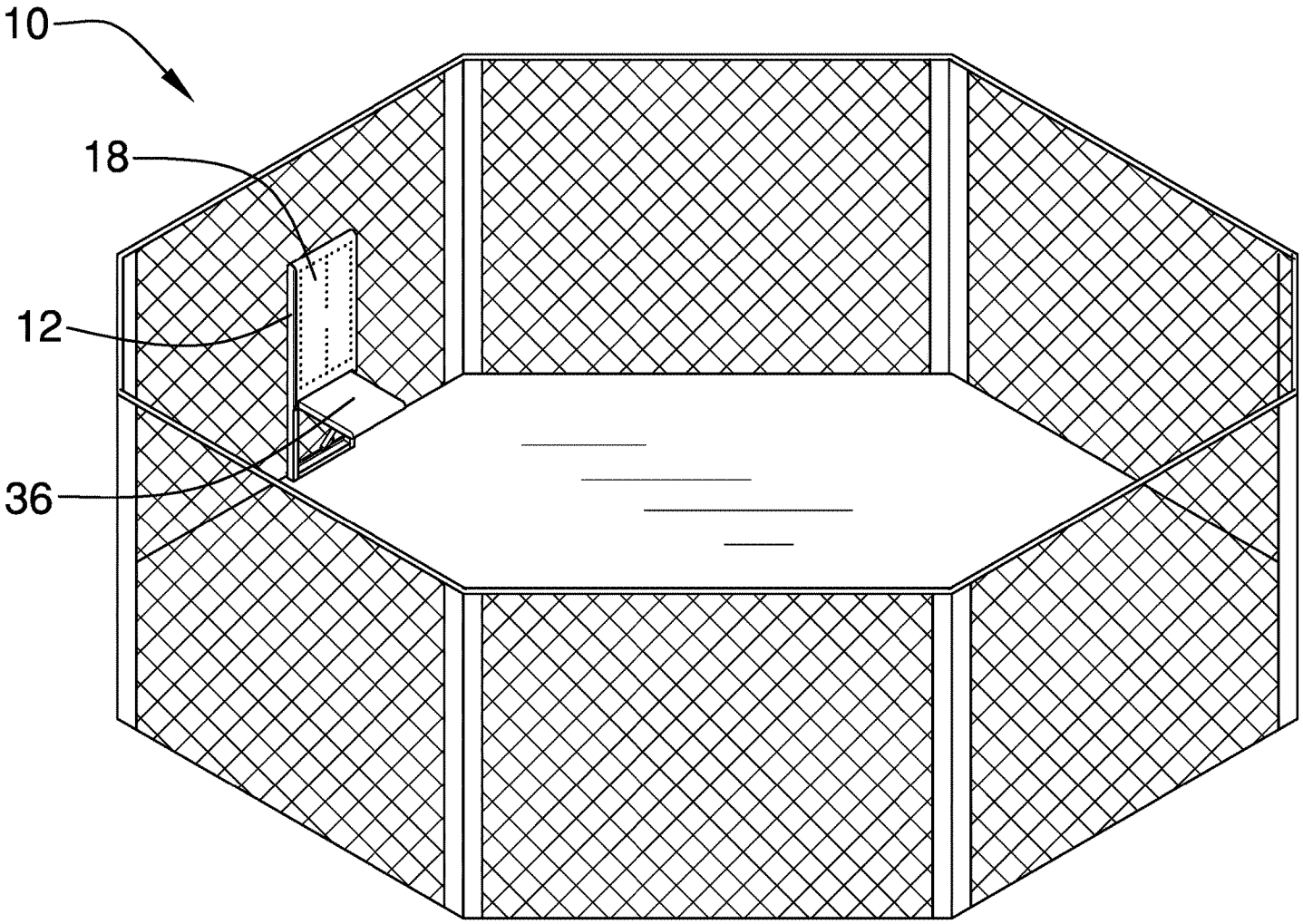
FIG. 5 is an in-use view of an embodiment of the disclosure.

As best illustrated in FIGS. 1 through 5, the corner chair assembly 10 generally comprises a frame 12 that is coupled to an enclosure of a competition ring, such as an octagon as shown in FIG. 5, a boxing ring, or the like. The frame 12 is rectangularly shaped. A power module 14 is coupled to the frame 12. The power module 14 comprises a battery 16.

A first plate 18 is coupled to and extends between a first side 20 and a second side 22 of the frame 12 proximate to a top 24 of the frame 12. The first plate 18 is padded. The first plate 18 is substantially rectangularly shaped.

A plurality of couplers 26 is coupled to the frame 12, as shown in FIG. 4. Each coupler 26 is configured to couple to an element of the enclosure so that the plurality of couplers 26 is configured to couple the frame 12 to the enclosure. The plurality of couplers 26 comprises three couplers 26.

Each coupler 26 comprises a strap 28, a first connector 30, and a second connector 32. The strap 28 is coupled to the first side 20 of the frame 12. The first connector 30 is coupled to the strap 28 distal from the frame 12. The second connector 32 is coupled to the second side 22 of the frame 12. The second connector 32 is complementary to the first connector 30. The strap 28 is configured to loopedly position around the element of the enclosure, such as a post or a rope, positioning the first connector 30 to couple to the second connector 32 to couple the frame 12 to the enclosure. Each first connector 30 and the second connector 32 comprise a hook and loop fastener 34.

A second plate 36 has an inner edge 38 that is hingedly coupled to a lower edge 40 of the first plate 18. The second plate 36 is substantially rectangularly shaped. The second plate 36 is padded.

Figure 2:
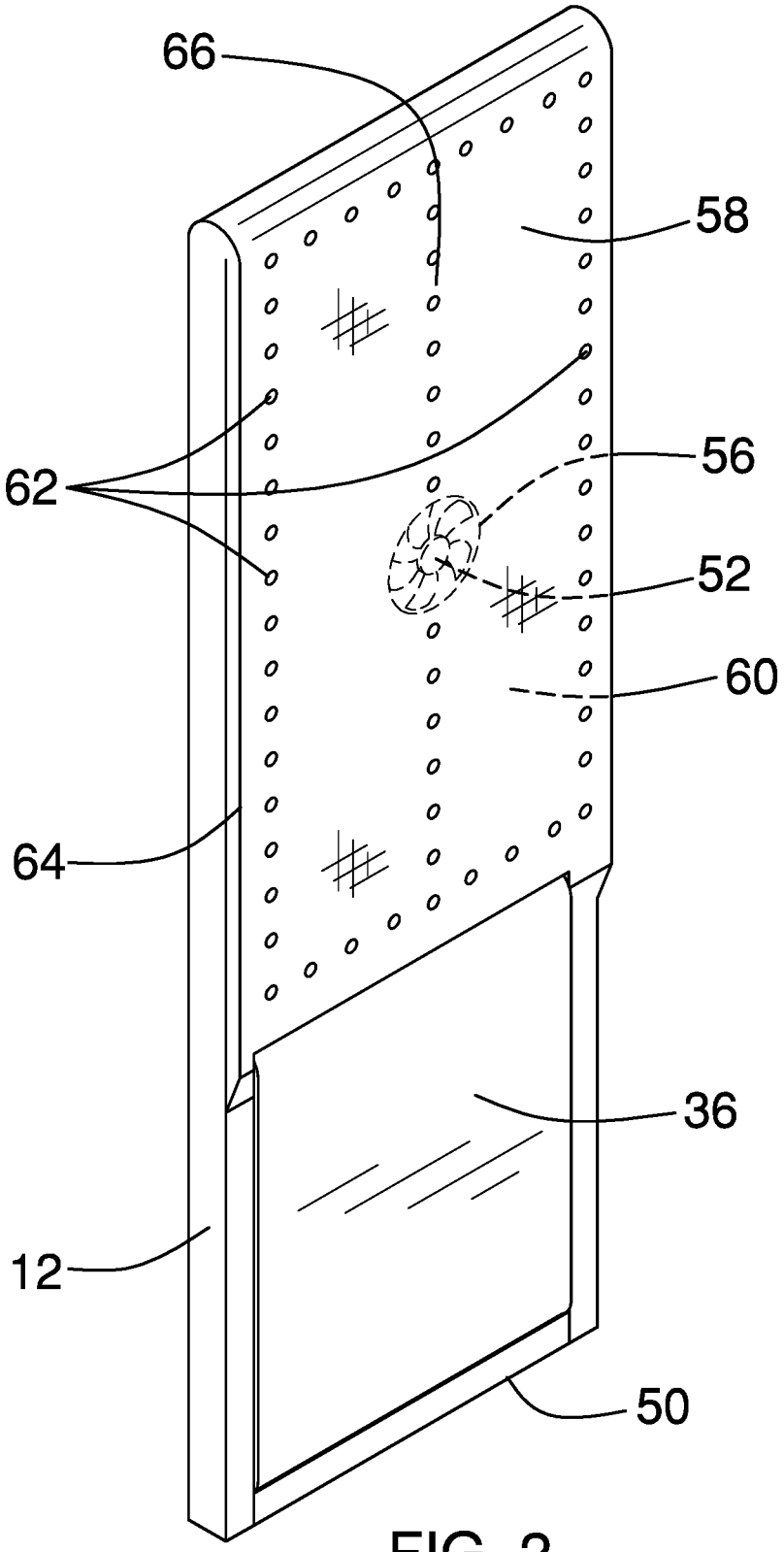
FIG. 2 is an isometric perspective view of an embodiment of the disclosure.

An actuator 42 is operationally coupled to the power module 14. The actuator 42 is coupled to the frame 12 and the second plate 36. The actuator 42 is configured to selectively urge the second plate 36 from a stowed configuration to a deployed configuration. In the stowed configuration, the second plate 36 is positioned coplanarly with the first plate 18, as shown in FIG. 2. In the deployed configuration, the second plate 36 extends substantially perpendicularly from a forward face 44 of the first plate 18, as shown in FIG. 1. The second plate 36 is configured to seat a competitor, positioning the first plate 18 to support a back of the competitor. One advantage of the current invention is eliminating the need to position and deploy a chair into the competition ring between every round. This eliminates the potential a delayed seating of the competitor and decreases the probability of a malfunction during deployment of the chair.

The actuator 42 comprises a rod 46 and a hydraulic cylinder 48. The rod 46 is coupled to and extends between the first side 20 and the second side 22 of the frame 12, proximate to a bottom 50 of the frame 12, as shown in FIG. 3. The hydraulic cylinder 48 is hingedly coupled to and extends between the second plate 36 and the rod 46.

A fan 52 is operationally coupled to the power module 14. The fan 52 is coupled to the first plate 18. The fan 52 is configured to blow air onto the competitor to cool the competitor.

A controller 54 is coupled to the frame 12. The controller 54 is operationally coupled to the power module 14, the actuator 42, and the fan 52. The controller 54 is positioned to selectively couple the actuator 42 to the power module 14 to power the actuator 42 to selectively urge the second plate 36 from the stowed configuration to the deployed configuration. The controller 54 also is positioned to selectively couple the fan 52 to the power module 14 to blow the air onto the competitor to cool the competitor.

An orifice 56 is positioned in the first plate 18. The fan 52 is positioned in the orifice 56 so that the fan 52 is substantially flush to the forward face 44 of the first plate 18.

A shell 58 is positioned over the forward face 44 of the first plate 18, as shown in FIG. 4. The shell 58 comprises leather or the like. A filler 60 is positioned between the shell 58 and the first plate 18. The filler 60 is resilient so that the filler 60 is configured to pad the first plate 18.

A plurality of holes 62 is positioned through the shell 58. The holes 62 are configured to direct the air onto the competitor. The plurality of holes 62 is positioned proximate to a perimeter 64 of the shell 58 and along a centerline 66 of the shell 58.

In use, the frame 12 is coupled to the enclosure of the competition ring. At the end of a round, a coach or assistant uses the controller 54 selectively couple the actuator 42 to the power module 14 to urge the second plate 36 to the deployed configuration to seat the competitor between rounds. The controller 54 also couples the fan 52 to the power module 14 to blow the air onto the competitor to cool the competitor between the rounds.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A corner chair assembly comprising:

a frame coupled to an enclosure of a competition ring;

a power module coupled to said frame;

a first plate coupled to and extending between a first side and a second side of said frame proximate to a top of said frame, said first plate being padded;

a second plate having an inner edge hingedly coupled to a lower edge of said first plate, said second plate being padded;

an actuator operationally coupled to said power module, said actuator being coupled to said frame and said second plate wherein said actuator is configured for selectively urging said second plate from a stowed configuration wherein said second plate is positioned coplanarly with said first plate to a deployed configuration wherein said second plate extends substantially perpendicularly from a forward face of said first plate such that said second plate is configured for seating a competitor positioning said first plate for supporting a back of the competitor; and a fan operationally coupled to said power module, said fan being coupled to said first plate wherein said fan is configured for blowing air onto the competitor for cooling the competitor.

2. The assembly of claim 1, further including said frame being rectangularly shaped.

3. The assembly of claim 1, further including said power module comprising a battery.

4. The assembly of claim 1, further including a plurality of couplers coupled to said frame, each said coupler being configured for coupling to an element of the enclosure wherein said plurality of couplers is configured for coupling said frame to the enclosure.

5. The assembly of claim 4, further including said plurality of couplers comprising three said couplers.

6. The assembly of claim 4, further including each said coupler comprising a strap, a first connector, and a second connector, said strap being coupled to said first side of said frame, said first connector being coupled to said strap distal from said frame, said second connector being coupled to said second side of said frame, said second connector being complementary to said first connector wherein said strap is configured for loopedly positioning around the element of the enclosure positioning said first connector for coupling to said second connector for coupling said frame to the enclosure.

7. The assembly of claim 6, further including each said first connector and said second connector comprising a hook and loop fastener.

8. The assembly of claim 1, further including said first plate and said second plate being substantially rectangularly shaped.

9. The assembly of claim 1, further including said actuator comprising a rod and a hydraulic cylinder, said rod being coupled to and extending between said first side and said second side of said frame proximate to a bottom of said frame, said hydraulic cylinder being hingedly coupled to and extending between said second plate and said rod.

10. The assembly of claim 1, further including a controller coupled to said frame, said controller being operationally coupled to said power module, said actuator, and said fan wherein said controller is positioned for selectively coupling said actuator to said power module for powering said actuator for selectively urging said second plate from the stowed configuration to the deployed configuration, wherein said controller is positioned for selectively coupling said fan to said power module for blowing the air onto the competitor for cooling the competitor.

11. The assembly of claim 1, further comprising:

an orifice positioned in said first plate, said fan being positioned in said orifice such that said fan is substantially flush to said forward face of said first plate;

a shell positioned over said forward face of said first plate;

a filler positioned between said shell and said first plate, said filler being resilient wherein said filler is configured for padding said first plate; and a plurality of holes positioned through said shell wherein said holes are configured for directing the air onto the competitor.

12. The assembly of claim 11, further including said shell comprising leather.

13. The assembly of claim 11, further including said plurality of holes being positioned proximate to a perimeter of said shell, said plurality of holes being positioned along a centerline of said shell.

14. A corner chair assembly comprising:

a frame coupled to an enclosure of a competition ring, said frame being rectangularly shaped;

a power module coupled to said frame, said power module comprising a battery;

a first plate coupled to and extending between a first side and a second side of said frame proximate to a top of said frame, said first plate being padded, said first plate and being substantially rectangularly shaped;

a plurality of couplers coupled to said frame, each said coupler being configured for coupling to an element of the enclosure wherein said plurality of couplers is configured for coupling said frame to the enclosure, said plurality of couplers comprising three said couplers, each said coupler comprising a strap, a first connector, and a second connector, said strap being coupled to said first side of said frame, said first connector being coupled to said strap distal from said frame, said second connector being coupled to said second side of said frame, said second connector being complementary to said first connector wherein said strap is configured for loopedly positioning around the element of the enclosure positioning said first connector for coupling to said second connector for coupling said frame to the enclosure, each said first connector and said second connector comprising a hook and loop fastener;

a shell positioned over a forward face of said first plate, said shell comprising leather;

a filler positioned between said shell and said first plate, said filler being resilient wherein said filler is configured for padding said first plate;

a second plate having an inner edge hingedly coupled to a lower edge of said first plate, said second plate being substantially rectangularly shaped, said second plate being padded;

an actuator operationally coupled to said power module, said actuator being coupled to said frame and said second plate wherein said actuator is configured for selectively urging said second plate from a stowed configuration wherein said second plate is positioned coplanarly with said first plate to a deployed configuration wherein said second plate extends substantially perpendicularly from said forward face of said first plate such that said second plate is configured for seating a competitor positioning said first plate for supporting a back of the competitor, said actuator comprising a rod and a hydraulic cylinder, said rod being coupled to and extending between said first side and said second side of said frame proximate to a bottom of said frame, said hydraulic cylinder being hingedly coupled to and extending between said second plate and said rod;

a fan operationally coupled to said power module, said fan being coupled to said first plate wherein said fan is configured for blowing air onto the competitor for cooling the competitor;

a controller coupled to said frame, said controller being operationally coupled to said power module, said actuator, and said fan wherein said controller is positioned for selectively coupling said actuator to said power module for powering said actuator for selectively urging said second plate from the stowed configuration to the deployed configuration, wherein said controller is positioned for selectively coupling said fan to said power module for blowing the air onto the competitor for cooling the competitor;

an orifice positioned in said first plate, said fan being positioned in said orifice such that said fan is substantially flush to said forward face of said first plate; and a plurality of holes positioned through said shell wherein said holes are configured for directing the air onto the competitor, said plurality of holes being positioned proximate to a perimeter of said shell, said plurality of holes being positioned along a centerline of said shell.

* * * * *